US007702510B2

(12) United States Patent
Eide et al.

(10) Patent No.: US 7,702,510 B2
(45) Date of Patent: Apr. 20, 2010

(54) SYSTEM AND METHOD FOR DYNAMICALLY SELECTING AMONG TTS SYSTEMS

(75) Inventors: Ellen M. Eide, Tarrytown, NY (US); Raul Fernandez, New York, NY (US); Wael M. Hamza, Yorktown Heights, NY (US); Michael A. Picheny, White Plains, NY (US)

(73) Assignee: Nuance Communications, Inc., Burlington, MA (US)

( * ) Notice: Subject to any disclaimer, the term of this patent is extended or adjusted under 35 U.S.C. 154(b) by 565 days.

(21) Appl. No.: 11/622,683

(22) Filed: Jan. 12, 2007

(65) Prior Publication Data

US 2008/0172234 A1 Jul. 17, 2008

(51) Int. Cl.
*G10L 13/08* (2006.01)
*G10L 13/00* (2006.01)

(52) U.S. Cl. ..... 704/260; 704/258

(58) Field of Classification Search ..... None
See application file for complete search history.

(56) References Cited

U.S. PATENT DOCUMENTS

| | | | | |
|---|---|---|---|---|
| 5,832,433 | A * | 11/1998 | Yashchin et al. | 704/260 |
| 6,141,642 | A * | 10/2000 | Oh | 704/260 |
| 6,243,681 | B1 * | 6/2001 | Guji et al. | 704/260 |
| 6,725,199 | B2 * | 4/2004 | Brittan et al. | 704/258 |
| 7,483,834 | B2 * | 1/2009 | Naimpally et al. | 704/270.1 |
| 2001/0047260 | A1 * | 11/2001 | Walker et al. | 704/260 |
| 2006/0041429 | A1 * | 2/2006 | Amato et al. | 704/260 |

* cited by examiner

*Primary Examiner*—Matthew J Sked
(74) *Attorney, Agent, or Firm*—Wolf, Greenfield & Sacks, P.C.

(57) ABSTRACT

Systems and methods for dynamically selecting among text-to-speech (TTS) systems. Exemplary embodiments of the systems and methods include identifying text for converting into a speech waveform, synthesizing said text by three TTS systems, generating a candidate waveform from each of the three systems, generating a score from each of the three systems, comparing each of the three scores, selecting a score based on a criteria and selecting one of the three waveforms based on the selected of the three scores.

17 Claims, 2 Drawing Sheets

SYSTEM AND METHOD FOR DYNAMICALLY SELECTING AMONG TTS SYSTEMS

BACKGROUND

The present disclosure relates generally to text-to-speech (TTS) systems, and, in particular, to a system and method for selecting among TTS systems dynamically.

The quality of the output of a text-to-speech synthesis system is dependent on the particular text presented as input; some sentences synthesize well, while others are plagued by discontinuities and bad prosody. Moreover, systems using different algorithms or different settings may behave differently on a given text. One system may perform better than another system on some texts, but worse on others. Typically, a TTS system uses a particular algorithm and system, and adjusts the parameters related to that algorithm and system.

BRIEF SUMMARY

Embodiments of the invention include a method for dynamically selecting among text-to-speech systems, the method including identifying text for converting into a speech waveform, synthesizing the text by two or more TTS systems, generating a candidate waveform from each of the systems, generating a score from each of the systems, comparing each of the scores, selecting a score based on a criteria and selecting one of the three waveforms based on the selected of the three scores.

Additional embodiments include a system for dynamically selecting among text-to-speech systems, including a first text synthesizer, a second text synthesizer, a third text synthesizer (or multiple synthesizers), an input device providing desired text to be converted into a speech output, to the first, second and third text synthesizers and an output device for receiving synthesized waveforms and a score from the first second and third text synthesizers, the output device determining a low cost score for each of the waveforms and generating one of the three waveforms with the lowest cost score as an output waveform as the speech output for said desired text.

Further embodiments include a storage medium with machine-readable computer program code for dynamically selecting among text-to-speech systems, the storage medium including instructions for causing a system to implement a method, including identifying text for converting into an output speech waveform, synthesizing the text by multiple TTS systems, generating a candidate waveform from each of the systems, generating a cost function score from each of the systems, associating each of the scores with the respective waveforms, identifying the lowest cost function score and generating the waveform associated with the lowest cost function score as the output speech waveform.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION

Exemplary embodiments include a system for dynamically and automatically selecting among TTS systems having different algorithms for generating waveforms. The desired text is synthesized several times by different systems, and the output is selected dynamically among the systems based on a confidence score or a minimum cost function score to produce the final synthetic speech output waveform. The score is used as a switch to select one of the available TTS renditions of the text as the speech output.

Various choices for the multiple TTS systems exist. In general, in the embodiments described herein, it is understood that several different TTS technologies can be implemented such as, but not limited to: a formant TTS engine; a concatenative TTS engine; a Hidden-Markov-Model-based engine, etc. Another choice is to use the same basic technology, but vary some of the parameters to generate different outputs. For example, the concatenative TTS engine has weights allow a trade-off of various aspects of the cost function. Therefore, in one implementation, a trade-off of spectral smoothness with closeness to the prosodic targets when selecting a segment for concatenation could be made. By adjusting the weights controlling this trade-off different output speech from the same system could be generated.

It is appreciated that the exemplary embodiments of the methods and systems described here apply to TTS for speech at various utterance pieces including sentence-by-sentence, word-by-word, syllable-by-syllable, etc.

Figure 1:
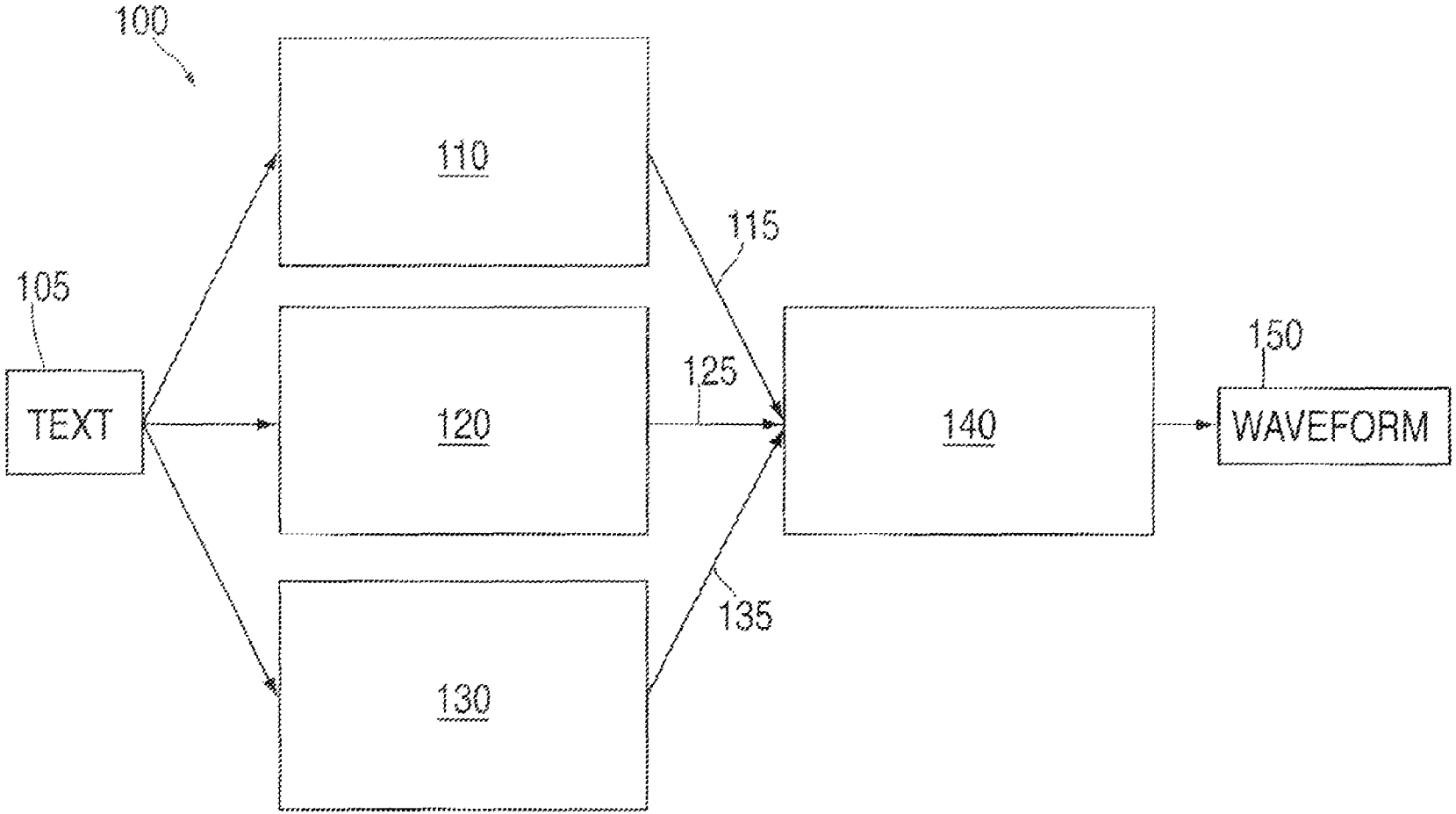
FIG. 1 illustrates a block diagram of an exemplary embodiment of a system for dynamically selecting among TTS systems.

FIG. 1 illustrates a block diagram of an exemplary embodiment of a system 100 for dynamically selecting among TTS systems. System 100 can include a text input device 105 that is independently coupled to each of a first TTS synthesizer (engine) 110, a second TTS synthesizer (engine) 120 and a third TTS synthesizer (engine) 130. Each TTS synthesizer 110, 120, 130 can include a different TTS application or algorithm for producing an output waveform. It is understood that some text forms may synthesize better or worse than another text form depending on the application or engine implemented to convert the text. Each synthesizer can therefore also product a score based on its voice synthesis from the given text input. In one implementation, a cost function is calculated and the cost function scores for each synthesizer 110, 120, 130 is compared and the lowest cost function scored waveform is chosen as the output of system 100. The selection process is discussed further in the description below.

Referring still to FIG. 1, each TTS synthesizer 110, 120, 130 can further include a respective output 115, 125, 135. Each output 115, 125, 135 is for carrying a speech waveform output and an associated score relating to the waveform. Each output 115, 125, 135 is coupled to a selector 140 for processing the score and the waveforms. As discussed above, scores are compared and the best speech output waveform is automatically selected. Selector 140 therefore includes hardware, software, firmware, etc., that can compare the scores, choose the lowest score, while keeping track of the waveform associated with that score. Selector 140 compares the internally generated scores from each of the synthesizers 110, 120, 130 and selects one system to generate the output speech. Speech from the other systems is simply discarded. The selection process can be as simple as looking for the maximum score, or as complicated as building a classifier on the scores to maximize the correlation of the scores with human perception of quality. The details of the selection process are primarily governed by the variety of the systems being compared. When the same basic technology is used but with different parameters, the internally generated scores may comparable. On the other hand, when different technologies are used for generating the candidate speech, the internally generated scores may not be comparable. In that case a classifier, which operates on the scores may be necessary. Selector 140 can therefore output the selected waveform having the lowest cost function score. Selector 140 is coupled to an output device 150 for outputting a selected waveform.

Therefore, in system 100, desired text 105 is synthesized by three systems 110, 120, 130, each of which generates a candidate waveform and a score reflecting the quality of its output 115, 125, 135. Those scores carried in output 115, 125, 135 are then compared and the waveform generated by the system reporting the lowest cost is selected as the best waveform for the text to be synthesized, and output by selector 140. The best waveform is taken as the output of the overall system 100.

As discussed above, the selection process is automatic and dynamic, based on a confidence score or other quality measure automatically assigned to each of the candidate TTS system 110, 120, 130 outputs 115, 125, 135. In exemplary embodiments, each synthesis system 110, 120, 140 reports a cost associated with synthesizing the desired text 105, which is output to selector 140. Cost reflects the ability of the system to achieve a smooth output, to match the desired pitch and durations, etc. For example, in the speech generation process, the degree of mismatch between the input text and the output waveform is determined by a cost function. Mismatch can be determined by a variety of factors such as but not limited to sequences of phonemes and prosodic characteristics (intonation). Many concatenative TTS systems use cost functions internally to select a sequence of segments to synthesize a given text. In general, the higher the cumulative cost function for a given piece of dialog (utterance), the worse the overall naturalness and intelligibility of the speech generated. Cost function is therefore an inherent measure of the quality of concatenative speech generation.

In an exemplary embodiment, system 100 uses of that same cost function as a means of assigning a measure of quality to the system outputs. The synthetic speech generated by the synthesis system reporting the lowest cost is then selected as the final output. In the case where the cost functions used by different systems are not directly comparable (e.g. one system multiplies all costs by 10, so that its scores tend to be larger than the scores of the other systems) a function of the scores rather than the scores themselves may be used, where the function normalizes the scores so that they may be compared.

The processing can actually occur at various levels. Fusion can be late, where the sentence or paragraph is generated by each candidate system and the entire passage is chosen from one of the systems based on cost. Fusion can also be early, where the decision for which system's output to choose happens at the phase, word, or sub-word level. When fusion happens earlier than at the sentence level, the sub-sentence portions of speech are concatenated at system output to form the desired sentence.

Figure 2:
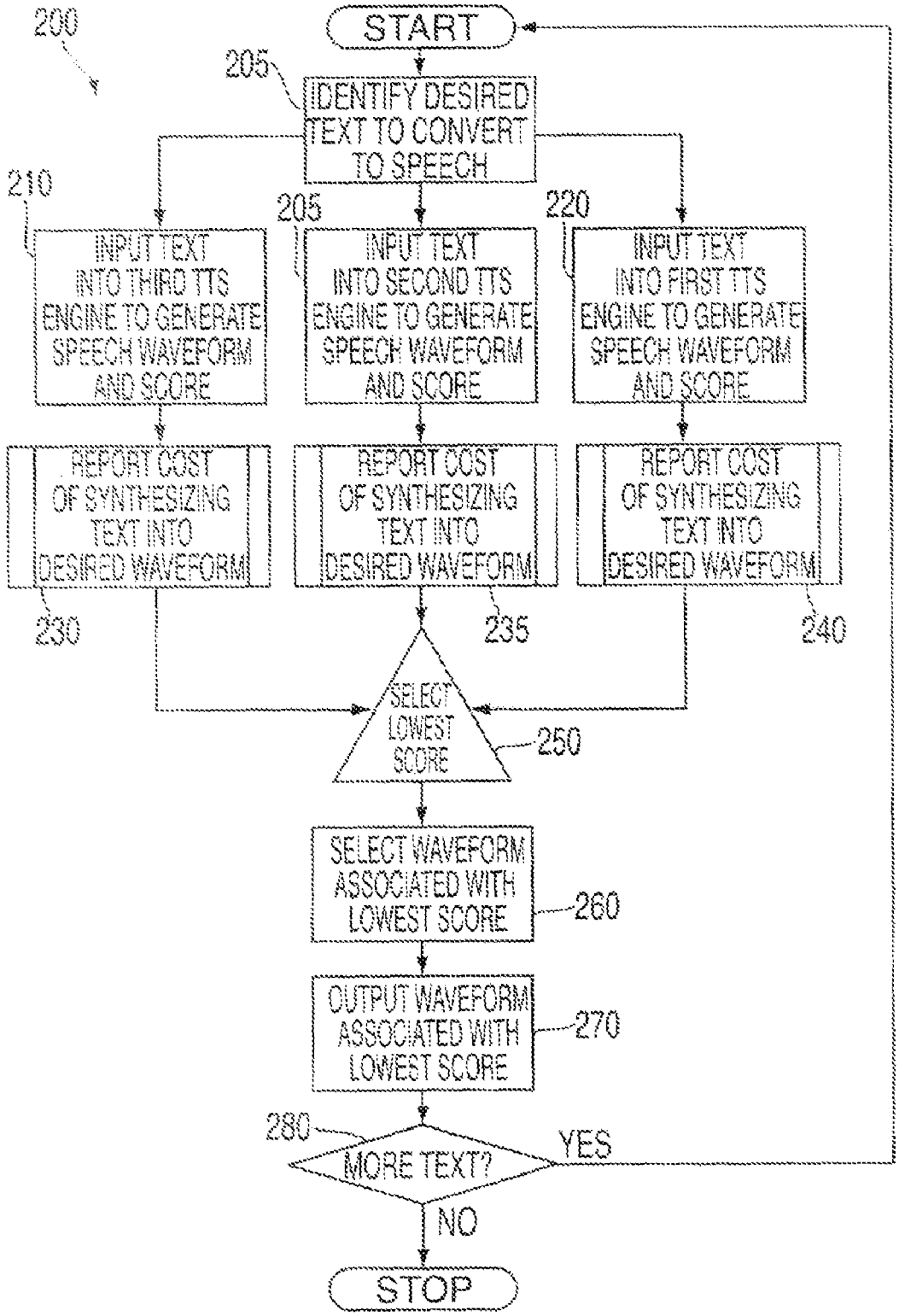
FIG. 2 illustrates a flow chart of an exemplary embodiment of a method for dynamically selecting among TTS systems.

FIG. 2 illustrates a flow chart of an exemplary embodiment of a method 200 for dynamically selecting among TTS systems. As discussed, desired text is selected at step 205. The text is input into three separate TTS engines that generate/synthesize a speech waveform based on three different techniques or algorithms at steps 210, 215, 220. A confidence or cost function score is further generated at steps 210, 215, 220. The cost of synthesizing the desired text is then reported at steps 230, 235, 240. The lowest scored is selected at step 250. A waveform associated with the lowest score is selected at 260. The selected waveform from step 260 is output as the chosen system output at step 270. The method 200 then determines if there is additional text to be synthesized into speech at step 280. If more text is to be synthesized at step 280, then the selection process is repeated. If no additional text is to be synthesized into speech, then the process stops.

It is appreciated that system 100 and method 200 as described above allow for automatic selection of the best waveform output for any given text. Therefore, for one section of desired text, the first engine may produce the lowest cost function score. Therefore, the waveform output of the first engine is automatically selected as the output waveform of the overall system. For the next section of desired text, the third engine may have the lowest cost function score. Therefore, the waveform output of the third engine is automatically selected s the output of the system. For the third section of text, the second engine may produce the lowest cost function score. Therefore, the output waveform of the second engine is automatically selected as the output of the overall system, and so on.

As described above, embodiments can be embodied in the form of computer-implemented processes and apparatuses for practicing those processes. In exemplary embodiments, the invention is embodied in computer program code executed by one or more network elements. Embodiments include computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. Embodiments include computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method for dynamically selecting among text-to-speech (TTS) systems, the method comprising:

synthesizing a first section of text using a first TTS system employing a first algorithm to produce a first speech waveform having an associated first score;

synthesizing the first section of text using a second TTS system employing a second algorithm to produce a second speech waveform having an associated second score;

normalizing, with at least one processor configured to execute a normalizing function, the first score and the second score to produce a first normalized score and a second normalized score; and selecting the first speech waveform or the second speech waveform for the first section of text based, at least in part, on a comparison of the first normalized score and the second normalized score.

2. The method as claimed in claim 1, wherein the first score and the second score are cost function scores.

3. The method as claimed in claim 2, wherein the speech waveform with the lowest cost function score is selected.

4. The method of claim 1, wherein the first score and the second score are confidence scores.

5. The method of claim 1, further comprising:

synthesizing a second section of text using the first TTS system to produce a third speech waveform having an associated third score;

synthesizing the second section of text using the second TTS system to produce a fourth speech waveform having an associated fourth score; and selecting the third speech waveform or the fourth speech waveform for the second section of text based, at least in part, on a comparison of the third score and the fourth score;

wherein the speech waveform selected for the second section of text was synthesized using a different TTS system then the speech waveform selected for the first section of text.

6. The method of claim 5, wherein the first section of text and second section of text are sub-sentence portions of text; and wherein the method further comprises:

concatenating the speech waveform selected for the first section of text with the speech waveform selected for the second section of text to form a concatenated speech waveform; and outputting the concatenated speech waveform.

7. A system for dynamically selecting among text-to-speech (TTS) systems, comprising:

a plurality of TTS systems, each configured to receive a first section of text and to generate a first corresponding speech waveform having an associated first cost score;

at least one processor configured to normalize the associated first cost scores generated by the plurality of TTS systems to produce a plurality of normalized first cost scores; and an output device configured to output one of said plurality of corresponding first speech waveforms having the lowest normalized first cost score from among the plurality of normalized first cost scores as speech output for said first section of text.

8. The system as claimed in claim 7, wherein said plurality of TTS systems comprises a first TTS system employing a first TTS application and a second TTS system employing a second TTS application that is different than the first TTS application.

9. The system as claimed in claim 8, wherein said first TTS application comprises a concatenative TTS engine and said second TTS application comprises a formant TTS engine.

10. The system of claim 7, wherein the plurality of TTS systems are further configured to each receive a second section of text and to generate a corresponding second speech waveform having an associated second cost score; and wherein the output device is further configured to output one of said plurality of corresponding second speech waveforms having the lowest associated second cost score from among the plurality of associated second cost scores as speech output for said second section of text;

wherein the speech waveform selected for the second section of text was synthesized using a different TTS system then the speech waveform selected for the first section of text.

11. The system of claim 10, wherein the first section of text and second section of text are sub-sentence portions of text; and wherein the system further comprises:

a concatenation device configured to concatenate the speech waveform selected for the first section of text with the speech waveform selected for the second section of text to form a concatenated speech waveform; and wherein the output device is further configured to output the concatenated speech waveform.

12. A computer-readable storage medium encoded with a plurality of instructions that, when executed by a computer, perform a method of dynamically selecting among text-to-speech (TTS) systems, the method, comprising:

synthesizing a first section of text using a first TTS system employing a first algorithm to produce a first speech waveform having an associated first score;

synthesizing the first section of text using a second TTS system employing a second algorithm to produce a second speech waveform having an associated second score;

normalizing the first score and the second score to produce a first normalized score and a second normalized score; and selecting the first speech waveform or the second speech waveform based, at least in part, on a comparison of the first normalized score and the second normalized score.

13. The computer-readable storage medium of claim 12, wherein the first score and the second score are cost function scores.

14. The computer-readable medium of claim 13, wherein the speech waveform with the lowest cost function score is selected.

15. The computer-readable storage medium of claim 12, wherein the first score and the second score are confidence scores.

16. The computer-readable storage medium of claim 12, wherein the method further comprises:

synthesizing a second section of text using the first TTS system to produce a third speech waveform having an associated third score;

synthesizing the second section of text using the second TTS system to produce a fourth speech waveform having an associated fourth score; and selecting the third speech waveform or the fourth speech waveform for the second section of text based, at least in part, on a comparison of the third score and the fourth score;

wherein the speech waveform selected for the second section of text was synthesized using a different TTS system then the speech waveform selected for the first section of text.

17. The computer-readable storage medium of claim 16, wherein the first section of text and second section of text are sub-sentence portions of text; and wherein the method further comprises:

concatenating the speech waveform selected for the first section of text with the speech waveform selected for the second section of text to form a concatenated speech waveform; and outputting the concatenated speech waveform.

* * * * *